US007916886B1

(12) United States Patent
Bobisuthi et al.

(10) Patent No.: US 7,916,886 B1
(45) Date of Patent: Mar. 29, 2011

(54) MICROPHONE WITH LOW FREQUENCY NOISE SHUNT

(75) Inventors: James F. Bobisuthi, Boulder Creek, CA (US); Lawrence Gollbach, Ben Lomond, CA (US)

(73) Assignee: Plantronics, Inc., Santa Cruz, CA (US)

( * ) Notice: Subject to any disclaimer, the term of this patent is extended or adjusted under 35 U.S.C. 154(b) by 970 days.

(21) Appl. No.: 11/809,847

(22) Filed: Jun. 1, 2007

Related U.S. Application Data

(62) Division of application No. 10/749,312, filed on Dec. 31, 2003, now Pat. No. 7,346,179.

(51) Int. Cl.
*H04R 17/02* (2006.01)

(52) U.S. Cl. ..... 381/355; 381/358; 381/360

(58) Field of Classification Search ..... 381/174, 381/176, 355, 356, 358, 359, 360, 369
See application file for complete search history.

(56) References Cited

U.S. PATENT DOCUMENTS

| | | | | |
|---|---|---|---|---|
| 6,738,484 | B2 * | 5/2004 | Nakabayashi | 381/174 |
| 7,260,236 | B2 * | 8/2007 | De Roo et al. | 381/356 |
| 2005/0025328 | A1 * | 2/2005 | Song | 381/174 |

* cited by examiner

*Primary Examiner* — Brian Ensey
(74) *Attorney, Agent, or Firm* — The IP Law Office of Thomas Chuang

(57) ABSTRACT

The present invention provides for a microphone. The microphone includes a housing, a port disposed in the housing leading to an interior chamber, and a diaphragm with a first side and a second side. The first side of the diaphragm faces the port. The microphone includes a shunt channel from the port to the second side of the diaphragm. The shunt channel receives a wind noise signal to reduce the effects of the wind noise signal on the diaphragm.

21 Claims, 4 Drawing Sheets

MICROPHONE WITH LOW FREQUENCY NOISE SHUNT

RELATED APPLICATIONS

This application is a divisional application of application Ser. No. 10/749,312, filed Dec. 31, 2003 now U.S. Pat. No. 7,346,179, entitled "Microphone with Low Frequency Noise Shunt".

TECHNICAL FIELD

The present invention relates to the general field of microphone devices. More specifically the invention relates to microphones with reduced sensitivity to the effects of low frequency noise.

BACKGROUND

Referring to FIG. 1, a prior art electret condenser microphone used with headsets and handsets is illustrated. A cylindrical housing capsule 102 holds the various components of the microphone. Housing capsule 102 includes a port 104 on the upper surface facing a 106. Voice signals are transmitted through port 104 to impinge on 106. A backplate 112 is fixed just behind port 104. A capacitance gap exists between 106 and backplate 112. A ring diaphragm spacer 110 is placed between 106 and backplate 112 to create the capacitance gap between 106 and backplate 112. A dielectric holder 114, FET 116, and PCB 118 are in the lower part of housing capsule 102. Housing capsule 102 is crimped to PCB 118. An input lead of FET 116 is coupled to backplate 112, and output lead is coupled to PCB 118. A cloth cover 120 may be placed over port 104 to prevent undesirable matter from entering the housing capsule 102 through port 104. In operation, sound waves impinge on diaphragm 106 causing diaphragm 106 to vibrate, thereby changing the capacitance between the diaphragm and fixed electrode in proportion to the strength of the sound waves. The change in capacitance is converted to a current or voltage change using FET 116.

Portable telephonic devices are often used in a wide variety of locations. Such use includes outdoor locations in less than ideal circumstances where wind is present. Wind adversely affects the performance of microphones in headsets or phones, manifesting itself in wind noise. Noise caused by wind in a microphone may result from passage of wind (moving air) or a person's breath that has entered the microphone port over the microphone diaphragm, causing the diaphragm to vibrate. Wind impinging on diaphragm 106 will be detected by the microphone along with the desired user speech and integrated into the microphone output signal as a low frequency signal component. The low frequency signal components will result in an audible rumbling noise at a receiver end, affecting the intelligibility of the user speech. Wind noise may also result from the sudden stoppage of the wind in the vicinity of the microphone diaphragm, such as at the edges of the port, or the passage of wind over the port and subsequent interaction with the edges of the port.

In the prior art, several attempts have been made to reduce the effects of wind noise. For example, telephone handsets have utilized windscreens placed in front of the microphone to prevent wind from impinging upon the microphone diaphragm. However, such wind screens are often bulky and aesthetically displeasing. Furthermore, windscreens may affect pickup of the desired speech signal. Such windscreens are particularly inconvenient when used with headsets, where considerations such as ease of portability, storage, and damage resistance increase in importance. In addition to windscreens, prior art solutions have utilized post FET output signal processing to filter out low frequency wind noise components of signal. However, because the wind noise still impinges on the diaphragm, the noise may overload the FET or cause excessive motion of the diaphragm, thereby reducing the quality of the detected speech signal. Still another prior art method involves placing a controlled perforation in the diaphragm to create a high pass filter function. Problems with this solution include sensitivity loss due to a reduction in the metallized area of the diaphragms, as well as the requirement of an additional step in the assembly process.

Thus, improved designs for telephonic devices with reduced sensitivity to wind noise are needed. In particular, there is a need for improved microphones that minimize the pickup of wind noise.

SUMMARY OF THE INVENTION

The present invention provides a solution to the needs described above through an inventive system and method for reduced noise in a microphone.

The present invention provides for a microphone. The microphone includes a housing, a port disposed in the housing leading to an interior chamber, a diaphragm, and a diaphragm support. The diaphragm support is disposed between the diaphragm and the housing, and has a channel. The microphone further includes a backplate and a diaphragm spacer disposed between the diaphragm and the backplate to create an air gap between the diaphragm and backplate. The diaphragm spacer includes a channel. The diaphragm, diaphragm support, backplate, and diaphragm spacer are disposed in the interior chamber, and the channels form a shunting channel for low frequency signal components around the diaphragm.

The present invention further provides a microphone including a housing having an inner surface with a channel. A port is disposed in the housing, leading to an interior chamber. The microphone further includes a diaphragm, diaphragm support disposed between the diaphragm and the housing, backplate, and a diaphragm spacer disposed between the diaphragm and the backplate. An insulating spacer is disposed in a lower portion of the interior chamber below the diaphragm and backplate, and the insulating spacer includes an insulator aperture adjacent the channel. The diaphragm, diaphragm support, backplate, diaphragm spacer, and insulating spacer are disposed in the interior chamber. The channel and the insulator aperture form a shunting channel for low frequency signal components around the diaphragm.

The present invention provides a method for reducing wind noise pickup in a microphone. The method includes providing a microphone with a housing, a port disposed in the housing leading to an interior chamber, a first channel from the port to a first side of the diaphragm facing the port, and a second channel from the port to a second side of the diaphragm. A voice signal and a wind noise signal are received through the port. The voice signal is propagated along the first channel and the wind noise is propagated along the second channel, thereby reducing the effects of the wind noise signal on the diaphragm.

The present invention further provides a microphone with reduced wind noise pickup. The microphone includes a housing, a port disposed in the housing leading to an interior chamber, a diaphragm, and a backplate. The microphone includes a diaphragm with a first side and a second side, where the first side faces the port. The microphone includes a shunt channel from the port to the second side of the diaphragm. The shunt channel receives a wind noise signal to reduce the effects of the wind noise signal on the diaphragm.

DESCRIPTION OF THE DRAWINGS

The features and advantages of the apparatus and method of the present invention will be apparent from the following description in which.

DETAILED DESCRIPTION OF THE PREFERRED EMBODIMENTS

The present invention provides a solution to the needs described above through an inventive microphone which reduces the pickup of wind noise by a microphone diaphragm.

Other embodiments of the present invention will become apparent to those skilled in the art from the following detailed description, wherein is shown and described only the embodiments of the invention by way of illustration of the best modes contemplated for carrying out the invention. As will be realized, the invention is capable of modification in various obvious aspects, all without departing from the spirit and scope of the present invention. Accordingly, the drawings and detailed description are to be regarded as illustrative in nature and not restrictive.

The present invention discloses a microphone with low wind noise pickup. The microphone is designed to provide a channel for wind noise entering a microphone chamber around the microphone diaphragm, thereby shunting the wind noise around the diaphragm and reducing wind noise pickup.

Figure 1:
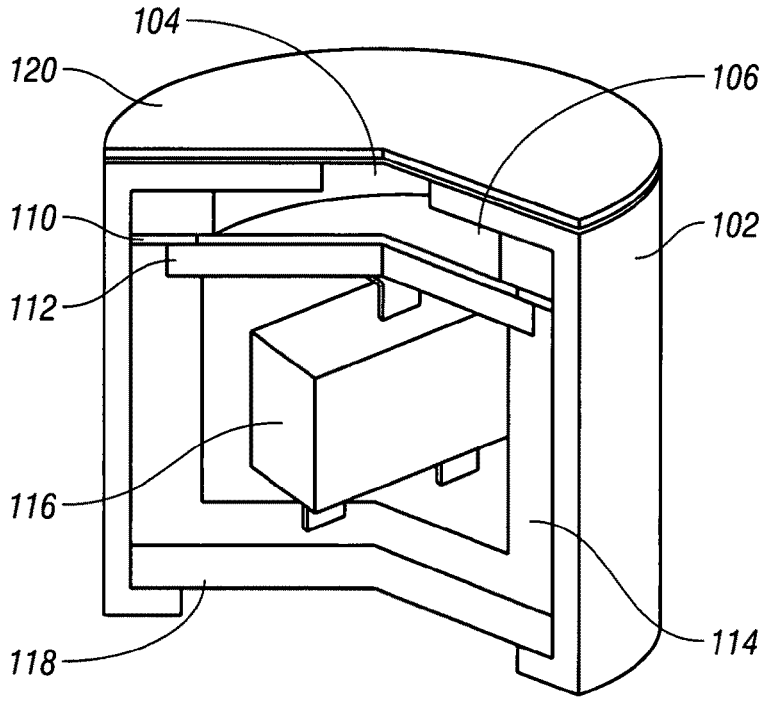
FIG. 1 (Prior Art)
FIG. 1 illustrates a prior art electret microphone.
Figure 2:
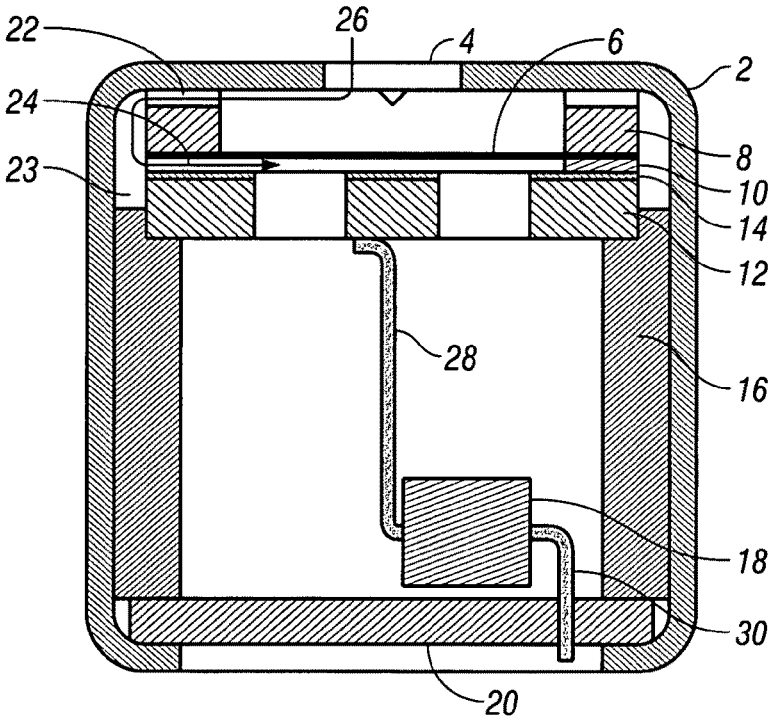
FIG. 2 illustrates a cross-sectional view of an embodiment of the microphone of the present invention.
Figure 3:
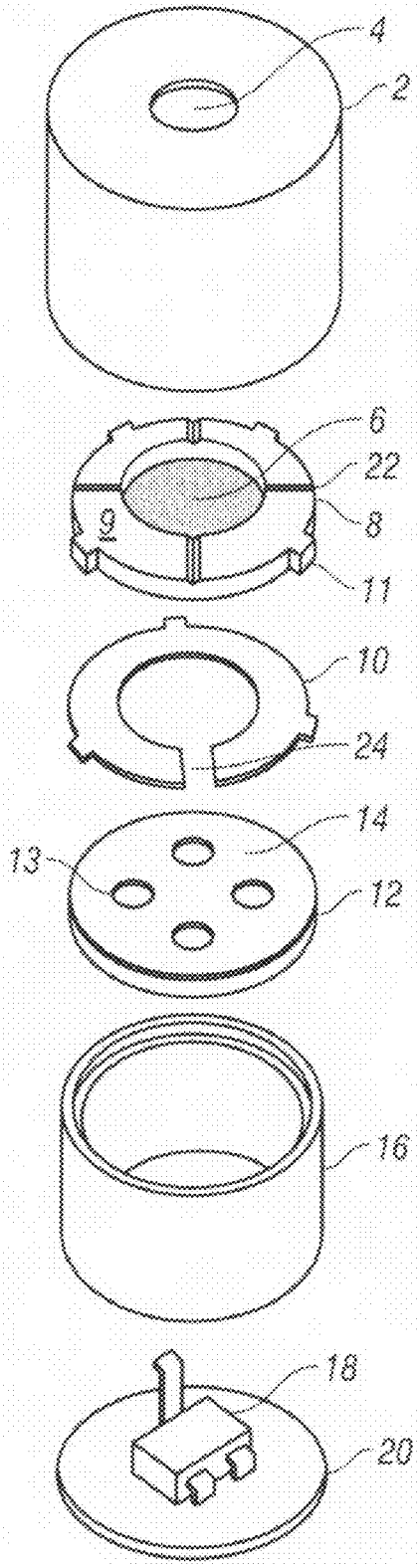
FIG. 3 illustrates a perspective view of the microphone of FIG. 2 in a disassembled state.

Referring to FIG. 2 and FIG. 3, a cross-sectional view of an embodiment of the inventive microphone is shown and a perspective view of the inventive microphone in a disassembled state is shown, respectively. In FIG. 3, relevant parts have been rotated to show the acoustic shunt channel which provides the low-frequency attenuation.

The inventive microphone includes an outer housing 2. In an embodiment, outer housing 2 is cylindrical in shape with a top and bottom surface and has a hollow interior chamber. A port 4 is disposed in the center of the top surface, providing an acoustic path to the interior chamber of the outer housing 2. The interior chamber accommodates the microphone components. The microphone components include a diaphragm 6, diaphragm support washer 8, diaphragm spacer 10, backplate 12, insulating spacer 16, FET 18, and PCB 20.

Diaphragm 6 is made of an electret material with a metal layer deposited on the surface and faces port 4. A diaphragm support washer 8 is disposed between the bottom surface of the top of outer housing 2 and diaphragm 6 in order to support and position the diaphragm 6 within the interior chamber of outer housing 2. In the outer housing 2, a backplate 12 with electret coating 14 is fixed just behind the port 4 with a capacitance gap created by a ring shaped diaphragm spacer 10 between the diaphragm 6 and the backplate 12, thereby forming a capacitor. Ring shaped diaphragm spacer 10 is constructed of a thin dielectric material with an inner radius and an outer radius and a hollow interior. A hollow cylindrical insulating spacer 16 is located in the lower portion of the interior chamber of outer housing 2, along with a FET 18 and a PCB 20. In an embodiment of the invention, the bottom portion of outer housing 2 is crimped to the outer edge of PCB 20. An input lead 28 of the FET 18 is connected to backplate 12, and one or more output leads 30 are connected to PCB 20 via an electrical pad on PCB 20.

Backplate 12 is made of metal with thru-holes 13 extending through. In accordance with an embodiment of the invention, ring shaped diaphragm spacer 10 has a slot 24. Slot 24 extends from the inner radius to the outer radius of diaphragm spacer 10 as illustrated in FIG. 3. Diaphragm support washer 8 is a ring shaped dielectric material with a hollow interior. Top surface 9 of diaphragm support washer 8 contains one or more grooves 22 extending from the inner radius to the outer radius, as illustrated in FIG. 3. Diaphragm support washer 8 also includes centering tabs 11 which form chamber 23. In accordance with an embodiment of the invention, groove 22, slot 24, and the chamber 23 between diaphragm support washer 8 and diaphragm spacer 10 and the inner wall of outer housing 12 combine to form a channel for wind noise around diaphragm 6, thereby reducing the effects of wind noise on diaphragm 6 and the resulting output signal from FET 18. In a further embodiment of the invention, rather than groove 22 in diaphragm support washer 8, a groove is formed in the inner surface of outer housing 12 to provide a channel to slot 24.

The above described microphone components are inserted into outer housing 2 through a bottom surface opposite the top surface with port 4. The components are inserted and fixed in order beginning with diaphragm support washer 8. Since groove 22 in diaphragm support washer 8 and slot 24 in diaphragm spacer 10 are pre-formed, shunt channel 26 is formed as diaphragm support washer 8 and diaphragm spacer 10 are inserted into outer housing 2. Only coarse alignment is required, and further modification may be made to increase immunity to assembly errors. For example, if the centering tabs 11 are not the full thickness of the diaphragm support washer 8 and more grooves were provided in the surface, variation due to assembly is reduced. As a result, the microphone of the present invention is easily assembled and mass production with high reliability is achieved.

The dimensions of the port 4 and interior chamber vary based on the microphone size and desired application. The diameter of the port, volume of the interior chamber within the housing, and the characteristics of the microphone transducer element affect the frequency response curve of the device. Characteristics of the microphone transducer element include stiffness, mass, and diaphragm area. These factors, including the design of the groove or slot are modified to achieve the desired frequency response curve. The greater the invention changes the volume of the interior air chamber, the more the frequency characteristics of the microphone are disturbed due to acoustic capacitance. In an embodiment of the invention, the dimensions of the groove or slot are adjusted so that the total impedance characteristics of the shunt path provide an 80 to 300 Hz cut-off frequency as it interacts with the acoustic and mechanical properties of the diaphragm. In additional embodiments, the cut-off frequency is adjusted depending on the desired pass-band, which is in turn dependent on the particular microphone application.

In an embodiment of the invention, the dimensions of slot 24 in the diaphragm spacer 10 are controlled to achieve the desired cut-off. In further embodiments, the dimensions of other segments of the shunt channel are controlled with the remaining portions sufficiently large in cross-section as to not affect the cut-off frequency. For example, by increasing the cross-sectional area of the other portions of the acoustic path by a factor of four, the effect of variations in those dimensions is reduced to at least one-fourth of their original contribution to the total error. Furthermore, a given mechanical tolerance represents a smaller percentage of the larger cross-section. Thus, the inventive microphone is designed to avoid accumulation of error and ensure that the corner frequency is controlled by as few and as well-controlled mechanical features as possible.

During operation of the inventive microphone in a windy environment, both wind and sound waves corresponding to user speech enter port 4. FET 18 converts a change in a capacity between the diaphragm 6 and backplate 12 caused by used speech sound waves impinging upon diaphragm 6 into a change in a voltage and current. Although the invention is described utilizing a FET 18, other suitable circuit devices may perform the same conversion function. The output of FET 18 is then propagated through output lead 30 to an electronic circuit located on PCB 20. The active components within inventive microphone are coupled via suitable electrical bonding material such as electrical solder or conductive adhesive.

In accordance with an embodiment of the invention, wind noise entering port 4 propagates along low resistance groove 22 around diaphragm 6. The wind noise is shunted through groove 22 disposed on diaphragm support washer 8 and through slot 24 in diaphragm spacer 10, and finally through thru-hole 13 on backplate 12. The diaphragm 6 thus primarily detects the speech sound waves.

Figure 4:
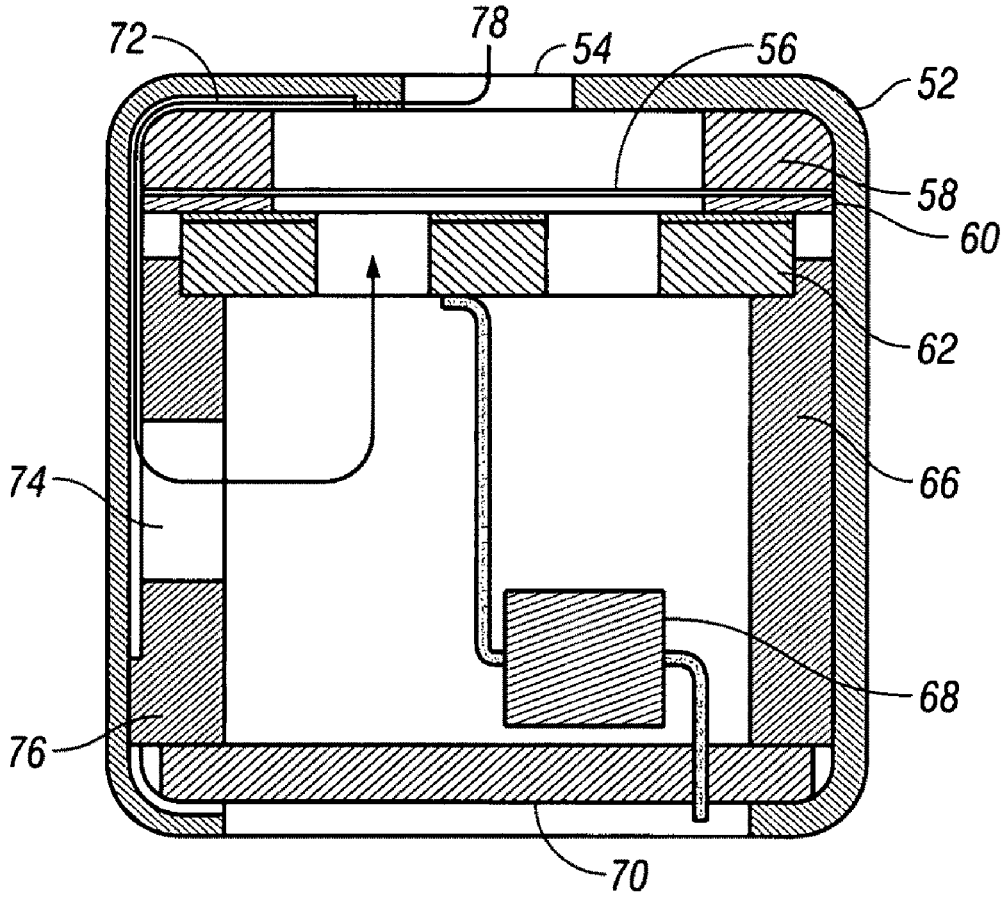
FIG. 4 illustrates a cross-sectional view of a further embodiment of the microphone of the present invention.
Figure 5:
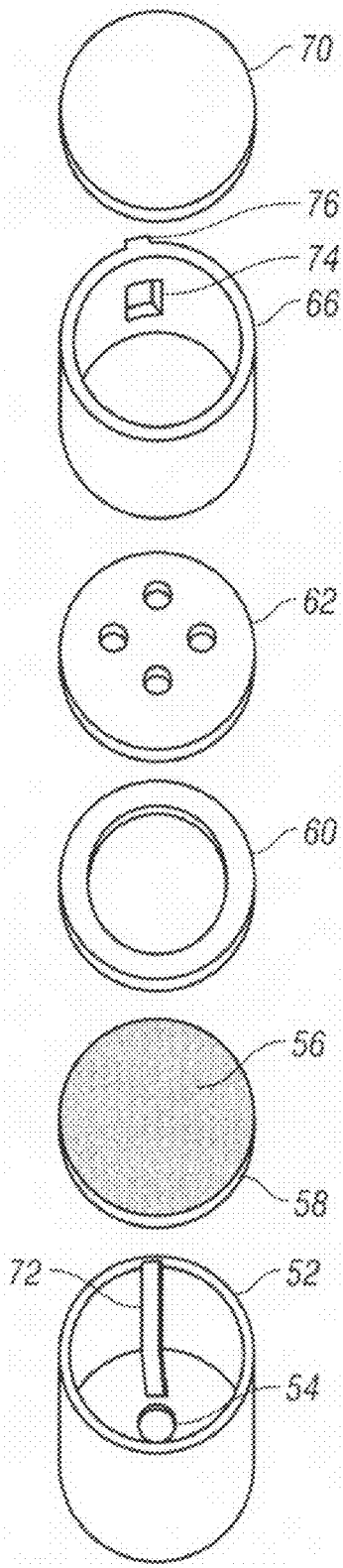
FIG. 5 illustrates a perspective view of the microphone of FIG. 4 in a disassembled state.

Referring to FIG. 4 and FIG. 5, a cross-sectional view of a further embodiment of the inventive microphone is shown along with a perspective view of the microphone in a disassembled state is shown. In this embodiment, the acoustic shunt channel is in part controlled by a groove formed on the interior surface of the outer housing when the outer housing is stamped.

The inventive microphone includes an outer housing 52. In an embodiment, outer housing 52 is cylindrical in shape with a top and bottom surface and has a hollow interior chamber. Outer housing 52 includes a groove 72 on the interior top and sidewall surface. A port 54 is disposed in the center of the top surface, providing an acoustic path to the interior chamber of the outer housing 52. The interior chamber accommodates the microphone components. The microphone components include a diaphragm 56, diaphragm support washer 58, diaphragm spacer 60, backplate 62, insulating spacer 66, FET 68, and PCB 70.

Diaphragm 56 is made of an electret material with a metal layer deposited on the surface and faces port 54. A diaphragm support washer 58 is disposed between the bottom surface of the top of outer housing 52 and diaphragm 56 in order to support and position the diaphragm 56 within the interior chamber of outer housing 52. In the outer housing 52, a backplate 62 is fixed just behind the port 54 with a capacitance gap created by a ring shaped diaphragm spacer 60 between the diaphragm 56 and the backplate 62. Ring shaped diaphragm spacer 60 is constructed of a thin dielectric and includes a hollow interior. A hollow cylindrical insulating spacer 66 is located in the lower portion of the interior chamber of outer housing 52, along with a FET 68 and a PCB 70. In an embodiment of the invention, the bottom portion of outer housing 52 is crimped to the outer edge of PCB 70. An input lead of the FET 68 is connected to backplate 62, and one or more output leads are connected to PCB 70 via an electrical pad on PCB 70.

In accordance with an embodiment of the invention, insulating spacer 66 has an aperture 74 in its sidewall which serves as a vent for wind noise. Insulating spacer 66 further has a molded protruding notch 76 which is vertically aligned with the aperture 74. Protruding notch 76 serves as a key during the assembly process to provide easy alignment of groove 72 and aperture 74. Groove 72 and aperture 74 combine to form a shunt channel 78 for wind noise around diaphragm 56, thereby reducing the effects of wind noise on diaphragm 56 and the resulting output signal from FET 68.

The above described microphone components are inserted into outer housing 52 through a bottom surface opposite the top surface with port 54. The components are inserted and fixed in order beginning with diaphragm support washer 58. With the use of protruding notch 76, insulating spacer 66 is easily inserted so that aperture 74 is aligned with groove 72 to form shunt channel 78. As a result, the microphone of the present invention is easily assembled and mass production with high reliability is achieved.

Alignment need only be approximate during assembly. The continuation of the groove as it is rolled to seal the can is treated to avoid a leak around the PCB, and can be sealed with solder or adhesive as necessary to prevent compromise of the acoustics of the microphone.

The present invention therefore provides for a microphone assembly with low wind noise pickup. The inventive microphone allows wind noise entering the microphone housing to be shunted away from the diaphragm, creating a channel between the front and back sides of the diaphragm while also controlling the channel dimensions to provide a desired high-pass characteristic to reduce the consequences of wind noise. Low frequencies are attenuated, and the channel component dimensions are adjusted to produce the desired cutoff frequency. Because the wind noise is shunted away from the diaphragm, it cannot overload the FET or cause excessive vibration of the diaphragm.

One of ordinary skill in the art will recognize that other architectures for the inventive microphone assembly may be employed. Although reference is made throughout the specification to an omni-directional microphone, the invention may also be applied to directional microphones. In omni-directional microphone applications, the shunt path may have a smaller cross section and greater length due to the higher acoustic and mechanical impedance of the microphone. In noise-canceling microphone applications, the shunt path has a larger cross-section or is shorter to account for the reduced impedance resulting from the open back port. Furthermore, although reference is made throughout the specification to reducing the effects of wind noise, the inventive microphone assembly may be used to reduce the effects of other types of noise, such as puff noise.

Having described the invention in terms of a preferred embodiment, it will be recognized by those skilled in the art that various types of components may be substituted for the configuration described above to achieve an equivalent result. It will be apparent to those skilled in the art that modifications and variations of the described embodiments are possible, and that other elements or methods may be used to perform equivalent functions, all of which fall within the true spirit and scope of the invention as measured by the following claims.

The invention claimed is:

1. A microphone comprising:

a housing, wherein an inner surface of the housing includes a housing channel;

a port disposed in the housing leading to an interior chamber;

a diaphragm;

a diaphragm support disposed between the diaphragm and the housing;

a backplate;

a diaphragm spacer disposed between the diaphragm and the backplate to create a gap between the diaphragm and backplate;

an insulating spacer disposed in a lower portion of the interior chamber below the diaphragm and backplate, wherein the insulating spacer includes an insulator aperture adjacent the housing channel, wherein the diaphragm, diaphragm support, backplate, diaphragm spacer, and insulating spacer are disposed in the interior chamber, and wherein the housing channel and the insulator aperture form a shunting channel for low frequency signal components around the diaphragm.

2. The microphone of claim 1, wherein the insulating spacer includes an alignment key aligned with the insulator aperture.

3. The microphone of claim 1, wherein the housing is a hollow cylinder with an inner and outer radius, and the insulating spacer is a hollow cylinder with an inner and outer radius, wherein the insulating spacer outer radius is slightly smaller than the inner radius of the housing.

4. The microphone of claim 1, wherein the low frequency signal components are caused by wind noise.

5. The microphone of claim 1, wherein the housing channel is a groove in the inner surface of the housing.

6. The microphone of claim 1, wherein the backplate includes a thru-hole which in part forms the shunting channel for low frequency components.

7. The microphone of claim 1, wherein the microphone is an omni-directional microphone.

8. The microphone of claim 1, wherein the microphone is a directional microphone.

9. The microphone of claim 1, further comprising a transistor and a printed circuit board, wherein the transistor is coupled to the backplate and the printed circuit board.

10. A microphone comprising:

a housing, wherein an inner surface of the housing includes a first channel;

a port disposed in the housing leading to an interior chamber;

a diaphragm;

a diaphragm support disposed between the diaphragm and the housing;

a backplate;

a diaphragm spacer disposed between the diaphragm and the backplate to create a gap between the diaphragm and backplate, wherein the diaphragm spacer includes a second channel, wherein the diaphragm, diaphragm support, backplate, and diaphragm spacer are disposed in the interior chamber, and wherein the first channel and second channel form a shunting channel for low frequency signal components around the diaphragm.

11. The microphone of claim 10, wherein the low frequency signal components are caused by wind noise.

12. The microphone of claim 10, wherein the diaphragm spacer is ring shaped with an inner radius and an outer radius, and the second channel is a slot extending from the inner radius to the outer radius.

13. The microphone of claim 10, wherein the backplate includes a thru-hole which in part forms the shunting channel for low frequency components.

14. The microphone of claim 10, wherein the first channel comprises a groove in the inner surface of the housing.

15. The microphone of claim 10, wherein the first channel is formed on a top inner surface of the housing and sidewall inner surface of the housing.

16. The microphone of claim 10, further comprising a transistor and a printed circuit board, wherein the transistor is coupled to the backplate and the printed circuit board.

17. The microphone of claim 16, wherein a bottom portion of the housing is crimped to an outer edge of the printed circuit board.

18. The microphone of claim 10, wherein the backplate includes a thru-hole which in part forms the shunting channel for low frequency components.

19. A method for reducing wind noise pickup in a microphone comprising:

providing a microphone with a housing, a port disposed in the housing leading to an interior chamber, a first channel from the port to a first side of a diaphragm facing the port, and a second channel from the port to a second side of the diaphragm, wherein the second channel comprises a housing channel disposed on an inner surface of the housing;

receiving a voice signal and a wind noise signal through the port;

propagating the voice signal along the first channel; and propagating the wind noise signal along the second channel, wherein the effects of the wind noise signal on the diaphragm are thereby reduced.

20. The method of claim 19, further comprising:

providing an insulating spacer disposed in a lower portion of the interior chamber below the diaphragm and backplate, the insulating spacer comprising an insulator aperture adjacent the housing channel; and propagating the wind noise signal through the insulator aperture.

21. A microphone comprising:

a housing means for housing a plurality of microphone components, the housing means comprising a first channel means for shunting low frequency signal components;

a porting means disposed in the housing means for receiving wind and sound waves corresponding to user speech, the porting means leading to an interior chamber;

a diaphragm means for detecting user speech;

a diaphragm support means for supporting the diaphragm means;

a backplate; and a diaphragm spacer means disposed between the diaphragm means and the backplate for creating a gap between the diaphragm means and backplate, wherein the diaphragm spacer means includes a second channel means for shunting low frequency signal components, wherein the diaphragm means, diaphragm support means, backplate, and diaphragm spacer means are disposed in the interior chamber, and wherein the first channel means and second channel means form a shunting channel for low frequency signal components around the diaphragm means.

* * * * *